United States Patent [19]

Pulitzer et al.

[11] 3,978,594

[45] Sept. 7, 1976

[54] DISPLAY AND MERCHANDIZING DEVICE FOR TIES

[75] Inventors: Sidney C. Pulitzer, New Orleans; Aubrey L. Gouner, Metairie, both of La.

[73] Assignee: Wembley Industries, Inc., New Orleans, La.

[22] Filed: Nov. 26, 1975

[21] Appl. No.: 635,554

Related U.S. Application Data

[62] Division of Ser. No. 541,185, Jan. 15, 1975.

[52] U.S. Cl. ..... 35/56; 206/458; 223/DIG. 1

[51] Int. Cl.[2] ..... B65D 85/18

[58] Field of Search ..... 35/28.3, 50, 56; 206/278, 279, 292, 295, 297, 458; 223/87, DIG. 1

[56] References Cited

UNITED STATES PATENTS

| | | | |
|---|---|---|---|
| 1,662,477 | 3/1928 | Samter | 35/56 |
| 1,704,793 | 3/1929 | Field | 35/56 |
| 1,901,941 | 3/1933 | York | 206/458 X |
| 1,994,382 | 3/1935 | Berger | 206/278 |
| 2,618,378 | 11/1952 | Miller | 206/295 |
| 2,910,214 | 10/1959 | Gouner | 223/87 |

*Primary Examiner*—Harland S. Skogquist
*Attorney, Agent, or Firm*—Beveridge, DeGrandi, Kline & Lunsford

[57] ABSTRACT

This invention relates to a device for displaying a plurality of men's colored ties in matched proximity to colored replicas of popular colored shirts. A group of ties, each having a distinctive design or color coordinated for wear with a particular colored shirt, are displayed in proximity to an image of the colored shirt and each individual tie is additionally provided with a wrapper bearing a replica of the collar portion of such colored shirt, the replica having a tie-shaped aperture in appropriate position to show the material of the actual tie in proper relationship with the particular colored shirt.

7 Claims, 7 Drawing Figures

FIG. 2
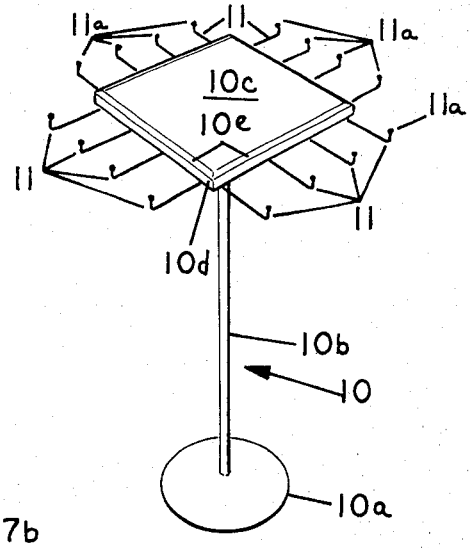
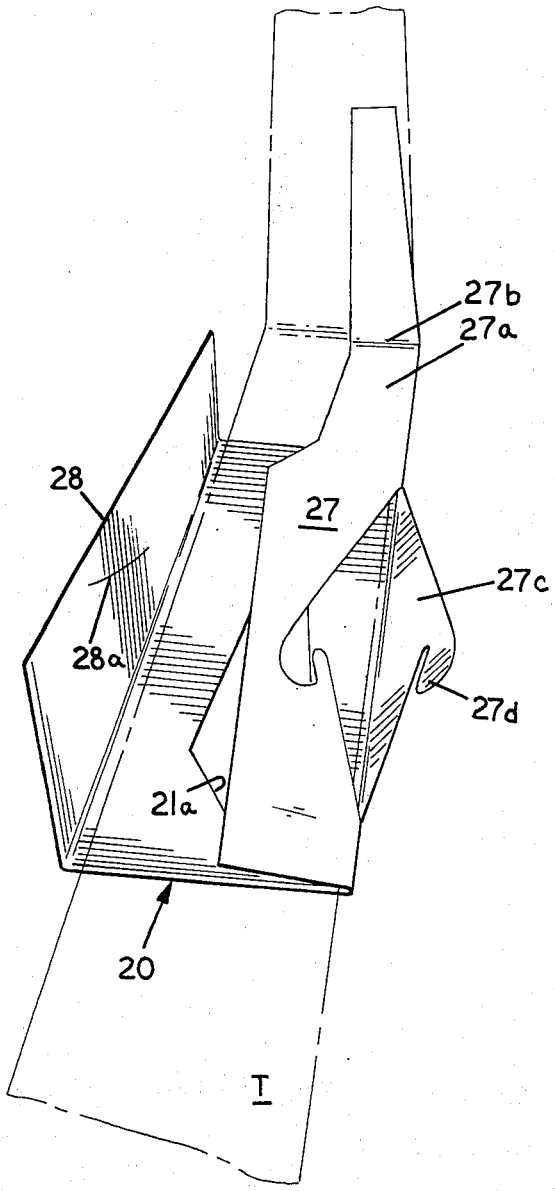
FIG. 6
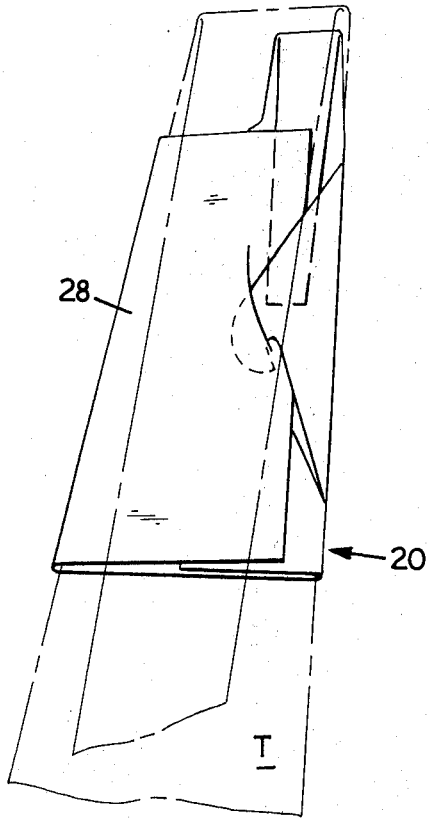
FIG. 7

DISPLAY AND MERCHANDIZING DEVICE FOR TIES

This application is a division of our co-pending earlier filed application Ser. No. 541,185, filed Jan. 15, 1975, entitled "Display and Merchandising Device for Ties".

BACKGROUND OF THE INVENTION

The recent changes in men's fashions have resulted in a large variety of colored shirts and myriad designs and colors of ties, some of which are properly co-ordinated with a particular colored shirt and others which definitely do not co-ordinate. When the ties are displayed separate from the colored shirts, the prospective customer invariably either removes ties from the racks for comparison with the shirts on a display table or carries the shirts to the tie rack. In either event, considerable time is consumed and the disarray of both the tie and the shirt display is inevitable.

OBJECTS OF THE INVENTION

It is an object of this invention to provide a unique display rack for men's colored ties characterized by the fact that color co-ordinated groups of such ties are displayed on a single hook beneath a colored image of an appropriate shirt for which such ties would be best suited.

A further object of the invention is to provide each tie with an individual wrapper, the wrapper bearing thereon a color replica of the same color shirt so that even when the individual tie is removed from the rack, the color co-ordination of a particular tie with a particular shirt color can be observed by the prospective customer. A further object of the invention is to provide an improved display wrapper for men's ties which may be quickly and conveniently assembled to a tie and provide on its front panel a display of the tie material in proper co-operative relationship with a colored image of a shirt and thus permits comparison of the tie with the particular colored shirt even when the tie is removed from the display rack.

Other objects and advantages of this invention will become apparent to those skilled in the art from the following detailed description, taken in conjunction with the annexed sheets of drawings, on which:

FIG. 2 is a reduced scale perspective view of a conventional tie rack to which the display accessories of this invention may be added.

FIG. 6 is a perspective view illustrating the first step of assembling the display wrapper to a tie.

FIG. 7 is a rear perspective view of the display wrapper assembled in position on the tie.

Figure 1:
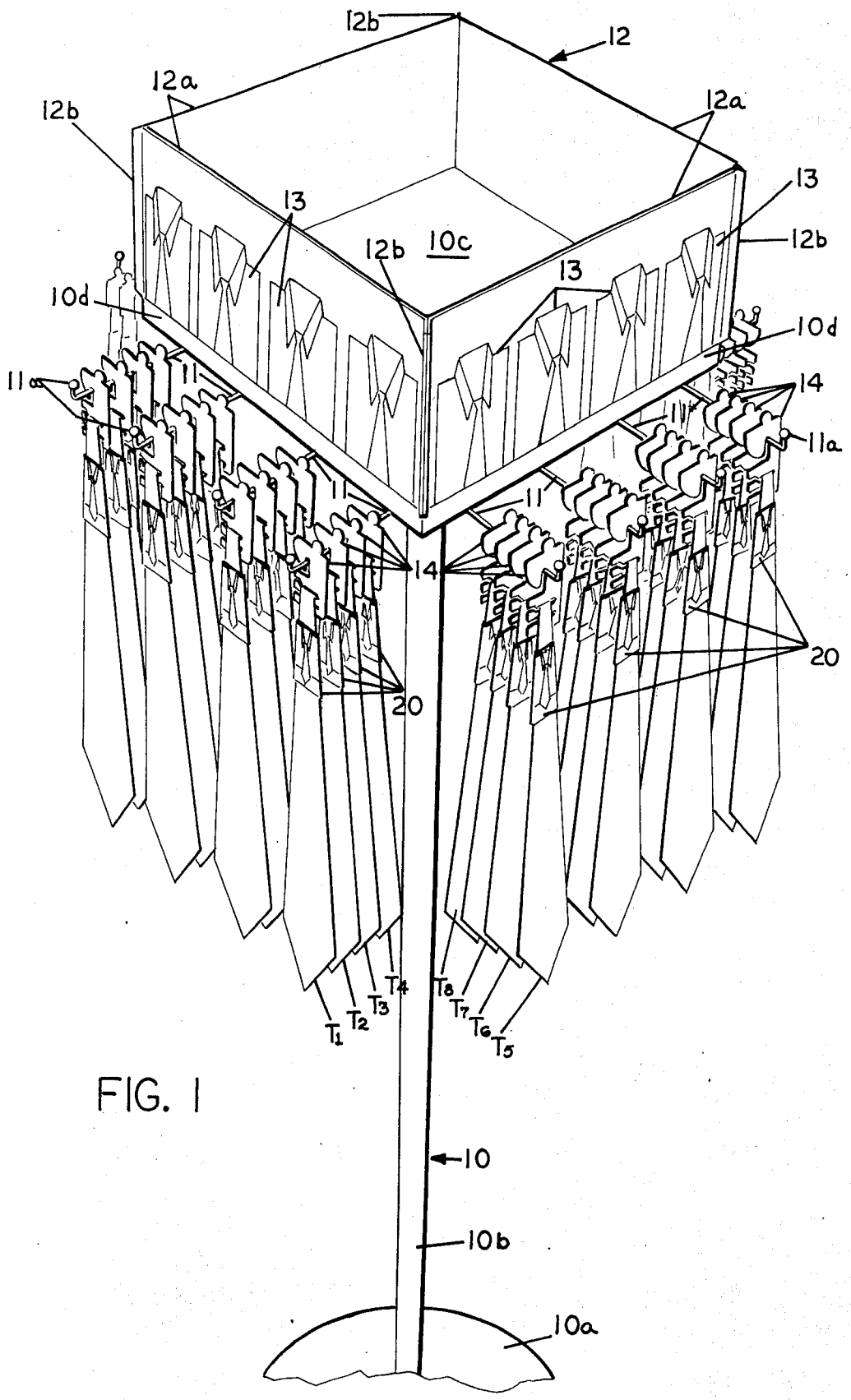
FIG. 1 is a perspective view of a complete tie display rack embodying this invention.
Figure 4:
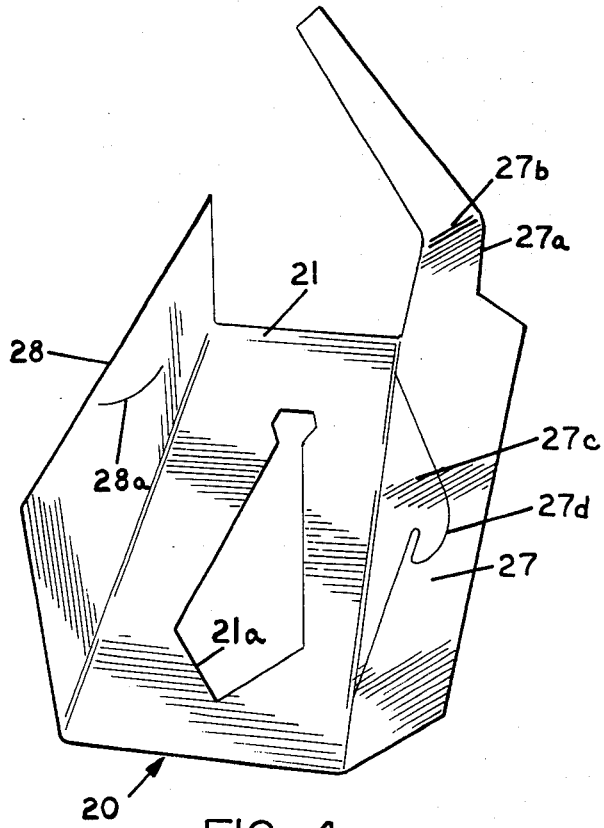
FIG. 4 is an enlarged scale, rear perspective view of a tie display wrapper shown in its partially folded, blank condition.

Referring to FIGS. 1 and 2, a tie display embodying this invention may be constructed upon any conventional tie rack 10 having a base 10*a*, an upstanding post 10*b* and a horizontally extending platen or frame 10*c* suitably rotatably secured to the top of post 10*b*. In the illustrated example, platen 10*c* is of square configuration but obviously could be a polygon or circular configuration.

Around the peripheral sidewalls 10*d* of frame 10*c* a plurality of mounting rods 11 are mounted. One end (not shown) of each rod 11 is threaded into sidewall 10*d* and the free end 11*a* is bent upwardly to form a retaining hook. The top portion of each side wall 10*d* is recessed as to 10*e* to provide a mounting ledge.

A color co-ordination guide 12 (FIG. 1) is mounted on top frame 10*c*. Guide 12 comprises a peripheral array of panels 12*a* snugly surrounding the recessed top wall 10*e* of frame 10*c*. Panels 12*a* are secured together by glued vertical joints 12*b*, thus forming a solid peripheral array of panel surface above the rods 11. The panels 12 are printed with a solid black background color.

Above each rod 11 there is printed a true color image 13 of an available shirt. In the illustrated example, 16 different shirt colors may be represented by the images 13. The tie portion of each image is colored black.

On each rod 11 beneath a particular shirt color image, a plurality of ties T1, T2 . . . T*n* are hung by conventional flat plastic hooks 14. Most importantly, each tie hung on a particular rod 11 will be color co-ordinated with the particular colored shirt image appearing immediately above the particular hook. Additionally each tie T has assembled thereto a display wrapper 20 which also bears a colored image of the same shirt. Thus, whether a tie is on the display rack or off it, the proper color shirt with which it should be worn will be displayed adjacent to the tie.

Referring now to FIGS. 3 through 7, the display wrapper 20 constitutes a blank sheet of printable material, such as a cardboard or a foldable plastic, which is die cut and creased or scored to provide the configuration to be hereinafter described in detail.

Blank 20 comprises a generally frustro-conically shaped front panel portion 21 on which is printed an image 22 of a shirt identical to one of the images 13 and in the exact color for which the particular tie was designed to co-ordinate with. Image 22 thus defines a collar portion 23 having spaced apart collar tips 23*a* and 23*b*. A tie-shaped aperture 21*a* is cut in panel portion 21 so as to permit the tie fabric to be viewed through the display wrapper in the exact position of a tie relative to the printed shirt image 22.

Rearwardly foldable securing tabs 27 and 28 are provided on each side of front panel portion 21. Tab 27 is additionally provided with a tapered extension 27*a* which projects in the direction of the length of the tie T around which the wrapper is assembled. Extension 27*a* is scored at a medial location by a fold line 27*b* and this line is located adjacent to the fold of a tie T to which the wrapper 20 is applied.

Figure 3:
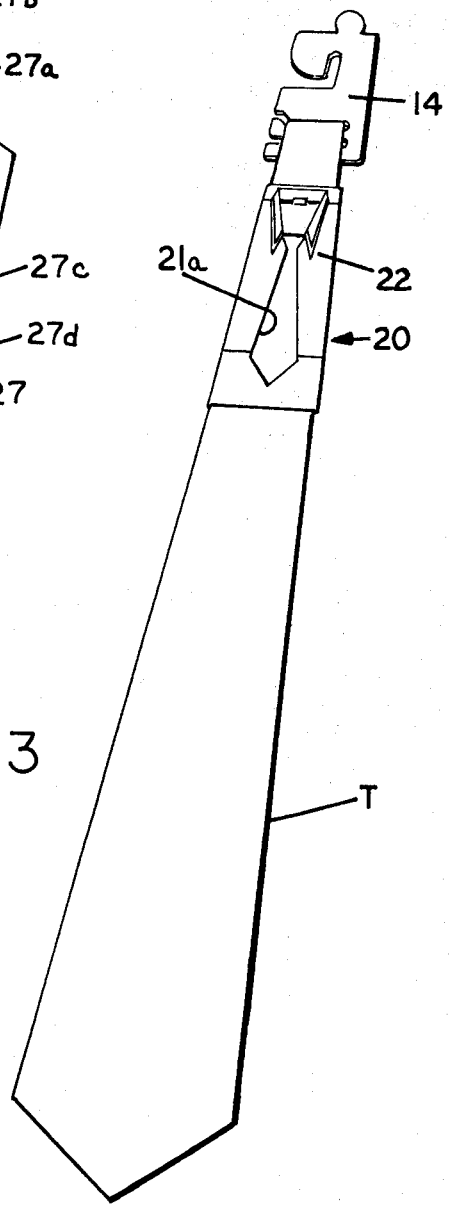
FIG. 3 is a plan view of a display wrapper embodying this invention assembled to a tie.
Figure 5:
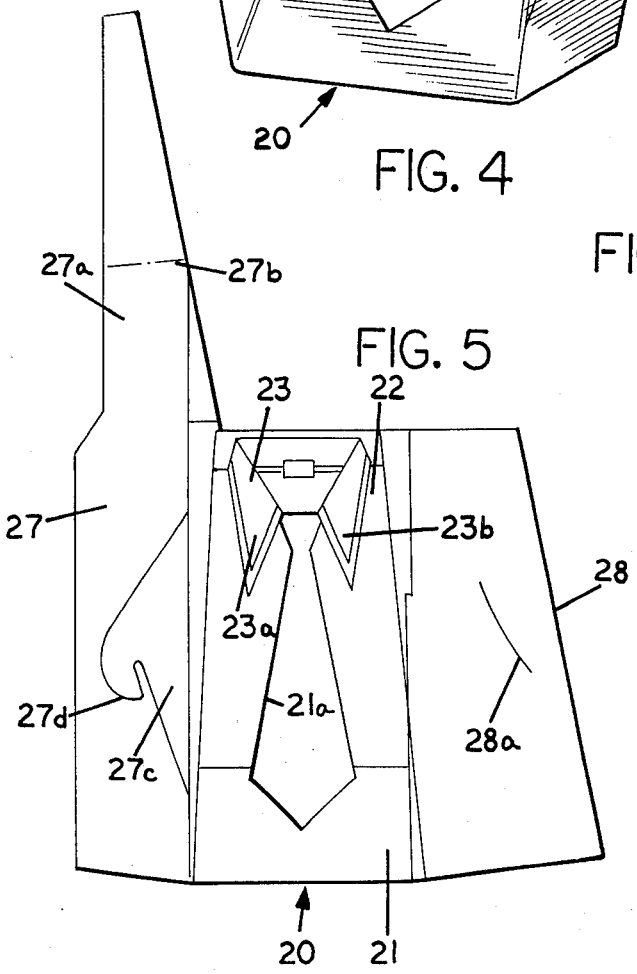
FIG. 5 is a front elevational view of the display wrapper of FIG. 4.

Referring particularly to FIGS. 6 and 7, the wrapper 20 is assembled to a tie T by laying it adjacent to the top portion of the front half of the tie when it is folded vertically and then folding both of the tab portions 27 and 28 rearwardly around the tie. The rear tab portion 27 is folded around the single thickness of the tie T so that the longitudinal extension 27*a* lies against the backside of the tie T, with the fold line 27*b* aligned with the vertical center line of the tie T around which it is normally folded when placed on a supporting hook 14 (FIG. 3). The small half of the tie T and the extreme end of the tab extension 27*a* are then folded to over-lie the tab 27. Tab 27 is additionally provided with a triangular-shaped cut-out 27*c* which is not folded against the single thickness of the inserted tie and is provided with a locking hook 27*d* at its vertex. The other rearwardly extending tab 28 is provided with a locking notch 28*a* and this tab 28 is folded around the double thickness layer of the tie, as best shown in FIG. 7, and then the cut-out 27*c* is folded on top of tab 28 and locking hook 27*d* inserted into the scored notch 28*a* to secure the wrapper 20 in assembly with the tie.

It will be noted that the longitudinal extension 27*a* of wrapper 20 provides a dual function. In the first place, it protects the inside surface of the tie from being snagged when the tie is slipped on a conventional supporting hook 14. More importantly, it precisely positions the wrapper 20 in desired relationship with respect to the tie so that each wrapper appears at exactly the same height position in the total display as illustrated in FIG. 1.

We claim:

1. A display wrapper for an individual tie comprising a die cut sheet of printable material defining:

1. a front panel portion dimensioned to overlie and conform to the top portion of the tie when folded about its longitudinal center, said front panel portion having printed thereon a colored replica of the front collar portion of a colored shirt;
2. a tie-shaped aperture extending between and below the opposed collar edges of said printed shirt replica, whereby the pattern of the tie is displayed as a miniature tie in proper position with respect to said printed shirt replica;
3. a first integral tab secured to one lateral edge of said front panel portion and foldable to lie between the two folded portions of the tie, said tab having a tapering longitudinal extension of lesser width than the adjacent portions of the tie, said extension projecting substantially beyond the longitudinal center of the tie, and being reversely folded to conform to the interior surfaces of the folded tie, thereby providing a tie protecting loop through which a tie mounting hook may be inserted, and also securing said wrapper in a desired vertical position relative to the folded tie;
4. a second integral tab secured to the other lateral edge of said front panel portion and foldable to lie adjacent to the back surface of the folded tie;
5. a medial portion of said first tab being cut to overlap both of said folded tie portions and lie contiguous with said second tab portion; and
6. means for detachably securing said medial portion of said first tab to said second tab.

2. A display wrapper for a man's tie comprising a sheet of foldable material having a frustro-conically shaped central portion adapted to overlie and conform to the top portions of a medially folded tie, a first integral tab secured to one lateral edge of said central portion and foldable to lie between the two adjacent surfaces of the folded tie, said tab having a longitudinal extension of lesser width than the adjacent portions of the tie, said extension projecting substantially beyond the tie fold and being laterally reversely folded to conform to the interior surfaces of the tie in the vicinity of the tie fold, thereby providing a tie protecting loop through which a tie support rod may be inserted, thus securing the wrapper in a desired vertical position on the folded tie, a second integral tab secured to the other lateral edge of said central portion and foldable to lie adjacent to the rearmost surface of the folded tie, a medial portion of said first tab being cut to encircle the folded tie and lie adjacent to said second tab portion, and means for detachably securing said medial portion of said first tab to the adjacent portion of said second tab, thereby securing the wrapper around the folded tie.

3. The display wrapper of claim 2 wherein said central portion is provided with a tie shaped opening to display the tie material.

4. A display wrapper for a man's tie comprising a die-cut sheet of foldable material having two horizontally spaced, angularly inclined fold lines defining therebetween a frustro-conical panel portion shaped to conform to and overlie the portions of a medially folded tie adjacent to the tie fold and two lateral tabs each adapted to fold around both portions of the folded tie and partially overlap behind the tie, means on the overlapped portions of the lateral tabs for detachably securing said tabs together to retain the wrapper on the folded tie, and an integral longitudinal extension on one of said tabs of lesser width than the tie and reversely folded to lie adjacent the internal surfaces of the folded tie on both sides of the tie fold, whereby a support member inserted in the tie fold can be engaged principally by said wrapper extension.

5. The display wrapper of claim 4 wherein said panel portion is provided with a tie shaped opening to display the tie material.

6. A display wrapper for an individual man's tie comprising a diecut sheet of foldable material defining:

1. a front panel portion dimensioned to overlie and conform to the top portions of the tie when the tie is folded about the longitudinal center;
2. a pair of integral tabs respectively secured to the two lateral edges of said front panel portion and foldable around both folded portions of the tie to lie contiguous to each other;
3. means for securing said contiguous portions of said integral tabs together to secure the wrapper in surrounding relationship to the folded tie; and
4. a longitudinally extending tab secured to one of said lateral edges of said front panel portion and being foldable to lie between the folded portions of the folded tie, said last mentioned tab being laterally reversely folded to conform to the interior surfaces of the tie in the vicinity of the tie fold, thereby providing a tie protecting loop through which a tie support rod may be inserted, thus securing the wrapper in a desired vertical position on the folded tie.

7. The display wrapper of claim 6 wherein said front panel portion has printed thereon a colored replica of the front collar portion of a colored shirt, and a tie shaped aperture extending between and below the opposed collar edges of said printed shirt replica, whereby the pattern of the tie is displayed as a miniature tie in proper position with respect to the printed shirt replica.

* * * * *